US012600004B2

(12) United States Patent
Pickrell et al.

(10) Patent No.: US 12,600,004 B2
(45) Date of Patent: Apr. 14, 2026

(54) LUG AND HUB CLEANING ATTACHMENT

(71) Applicant: INFINITE CONCEPTS & MANUFACTURING, Waynesville, OH (US)

(72) Inventors: Chris A. Pickrell, Tipp City, OH (US); Timothy S. Stover, Waynesville, OH (US); Arlie D. Williams, Xenia, OH (US)

(73) Assignee: Infinite Concepts & Manufacturing, Waynesville, OH (US)

( * ) Notice: Subject to any disclaimer, the term of this patent is extended or adjusted under 35 U.S.C. 154(b) by 1726 days.

(21) Appl. No.: 16/828,771

(22) Filed: Mar. 24, 2020

(65) Prior Publication Data

US 2020/0306919 A1 Oct. 1, 2020

Related U.S. Application Data

(60) Provisional application No. 62/823,069, filed on Mar. 25, 2019.

(51) Int. Cl.
*B24B 29/00* (2006.01)
*B24B 7/10* (2006.01)
(Continued)

(52) U.S. Cl.
CPC ..... *B24B 29/005* (2013.01); *B24B 7/10* (2013.01); *B24B 23/005* (2013.01); *B24B 23/02* (2013.01); *B24B 27/0076* (2013.01)

(58) Field of Classification Search
CPC ..... B60S 3/04; B24B 5/44; B24B 5/46; B24B 29/005; B24B 29/02; B24B 9/02; B24B 9/04; B24B 9/007; B24B 5/01; B24B 5/05; B24B 5/14; B24B 5/22; B24B 5/36; B24B 5/366; B24B 7/10; B24B 19/007; B24B 23/005; B24B 23/02; B24B 27/0076;
(Continued)

(56) References Cited

U.S. PATENT DOCUMENTS 3,486,276 A * 12/1969 Block ..... B24D 9/003 403/364
5,123,763 A 6/1992 Simmons
(Continued)

FOREIGN PATENT DOCUMENTS

JP 2018069350 A * 5/2018 ..... B24D 13/10
WO WO-2019133536 A1 * 7/2019 ..... A46B 13/001

OTHER PUBLICATIONS

Machine Translation of JP-2018069350-A (Year: 2018).*

*Primary Examiner* — Michael A Gump
(74) *Attorney, Agent, or Firm* — Thomas E. Lees, LLC

(57) ABSTRACT

A tool attachment for cleaning wheel hub components, comprises a tool body having a drive end, and a cleaning end. The cleaning end comprises a lug receiving opening extending into the tool body from an axial end thereof, and an axial end face. Moreover, a brush strip is positioned in an interior surface of a chamber within the cleaning end of the tool body. In some embodiments, the brush strip is replaceable. Further, the tool attachment includes an abrasive disk having an aperture therethrough that aligns with the lug receiving opening. In this regard, the abrasive disk attaches to the axial end face of the tool body. In some embodiments, the abrasive disk is replaceable.

17 Claims, 18 Drawing Sheets

(51) Int. Cl.
*B24B 23/00* (2006.01)
*B24B 23/02* (2006.01)
*B24B 27/00* (2006.01)

(58) Field of Classification Search
CPC ..... B24B 29/04; B24B 29/06; B24B 29/08; B24B 45/003; B24D 13/02; B24D 13/10; B24D 13/14; B24D 13/142; B24D 13/145; B24D 7/18; A46B 13/001; A46B 13/02; A46B 7/10; A46B 2200/3073; A46B 2200/3093
USPC ..... 451/57, 65, 66, 344, 548, 549, 550, 909, 451/259
See application file for complete search history.

(56) References Cited

U.S. PATENT DOCUMENTS 6,067,686 A 5/2000 Gronkiewicz
6,754,932 B2 * 6/2004 Buzard ..... B60S 3/042 15/210.1
6,802,765 B1 * 10/2004 Torrez ..... F02F 7/0046 451/344
7,631,385 B2 12/2009 Schouten
8,032,970 B2 * 10/2011 Chen ..... A46B 13/001 15/160
8,365,338 B1 2/2013 Figaro
8,764,517 B2 * 7/2014 Telischak, Jr. ..... B24D 13/142 451/508
9,216,439 B2 * 12/2015 Le Blanc ..... A46B 13/02
2004/0031112 A1 * 2/2004 Saurer ..... B08B 9/057 15/4
2005/0005742 A1 * 1/2005 Marrocco ..... B25J 15/04 81/177.85
2005/0227598 A1 * 10/2005 Ploeger ..... B24B 23/02 451/359
2006/0112506 A1 * 6/2006 Smart ..... A46B 13/001 15/104.04
2006/0112508 A1 * 6/2006 Kuivikko ..... A46B 7/08 15/87
2009/0181603 A1 * 7/2009 Krompack ..... F16C 3/02 464/183
2011/0005012 A1 * 1/2011 Le Blanc ..... B08B 1/04 15/21.1
2019/0193689 A1 * 6/2019 Sacha ..... B08B 1/36
2022/0032422 A1 * 2/2022 Umbrell ..... B25B 21/00

* cited by examiner

LUG AND HUB CLEANING ATTACHMENT

CROSS REFERENCE TO RELATED APPLICATIONS

This application claims the benefit of U.S. Provisional Patent Application Ser. No. 62/823,069, filed Mar. 25, 2019, entitled LUG AND HUB CLEANING ATTACHMENT, the disclosure of which is hereby incorporated by reference.

BACKGROUND

Various aspects of the present disclosure relate to a cleaning attachment that couples to a power tool, such as an impact driver, lug wrench, etc., and in particular to a cleaning attachment that cleans vehicle components, including hub components, e.g., tire lugs, corresponding wheel hub, flanges, etc.

Vehicles, trailers, and other over-the-road structures rely upon wheels that attach to corresponding axles to facilitate movement. Briefly, a wheel hub assembly is located between brake drums (or discs) and a drive axle. The wheel hub assembly typically includes a hub having a hub flange, and threaded studs (referred to as lugs) that extend orthogonally outward from the hub flange. The lugs extend in a pattern that aligns with lug openings in a corresponding wheel rim. The wheel rim mounts against the wheel hub such that each lug projects through a corresponding lug opening in the rim. Lug nuts tighten against the rim, thus securing the wheel rim to the wheel hub assembly. A tire is mounted to the rim and is typically inflated with air or other suitable gas, thus defining a system suitable for motion.

BRIEF SUMMARY

According to aspects of the present disclosure, a tool attachment for cleaning wheel hub components comprises a tool body having a drive end and a cleaning end. The cleaning end comprises an axial end face, a lug receiving opening extending into the tool body through the axial end face, and a chamber. The tool attachment also comprises a brush strip (e.g., brushes, bristles, or other cleaning features). In some embodiments, the brush strip comprise a replaceable brush strip that is releasably securable within the chamber of the cleaning end. In other embodiments, the brush strip can be permanently secured within the chamber of the cleaning end. Regardless of configuration, the brush strip is used to clean a lug as described in greater detail herein.

In some embodiments, the tool attachment also includes an abrasive disk holder having an aperture therethrough. The abrasive disk holder is adjacent to the axial end face such that the aperture aligns with the lug receiving opening. In some configurations, the abrasive disk holder is fixed to the axial end face of the tool attachment. In other configurations, the abrasive disk holder is detachable from the axial end face of the tool attachment. Regardless of configuration, the abrasive disk holder attaches an abrasive disk to the axial end face of the tool body. Here, the abrasive disk can be permanently attached to the abrasive disk holder, or the abrasive disk can be detachable from the abrasive disk holder.

In some embodiments, the abrasive disk holder is detachably connectable to the axial end face such that, when attached to the axial end face, the aperture aligns with the lug receiving opening. Further, in some embodiments, the abrasive disk has a disk aperture that extends therethrough such that when installed on the abrasive disk holder, the disk aperture aligns with the abrasive disk holder aperture. Moreover, in some embodiments, the abrasive disk has a first abrasive surface on a major face of the abrasive disk and, optionally, a second abrasive surface defining the side walls of the disk aperture. This allows, for instance, the abrasive disk to clean a hub flange via the major face, a lug via the side walls of the disk aperture, a combination thereof, etc.

Yet further, in some embodiments, the abrasive disk holder is not necessary, e.g., where an abrasive disk is otherwise mounted (permanently or temporarily) or is otherwise mountable, to the tool attachment, e.g., using adhesive, pins, threads, or other securement.

According to further aspects of the present disclosure, a tool attachment for cleaning wheel hub components comprises a tool body having a drive end, a cleaning end, and an arm portion extending between the drive end and the cleaning end. The cleaning end comprises an axial end face, and a lug receiving opening extending into the tool body through the axial end face, thus providing an opening into a chamber within the cleaning end of the tool body. The chamber has a diameter that is greater than a diameter of the lug receiving opening.

In some embodiments, the chamber is configured to receive a replaceable brush strip as described in greater detail herein. As noted above, in other embodiments, the brush strip can be permanently installed in the chamber.

When a replaceable brush strip is installed in the tool body, a first edge of the brush strip engages a first side of an abutment member, and a second edge, opposite the first edge, of the brush trip engages a second side of the abutment member, so as to prevent the replaceable brush strip from slipping or otherwise rotating relative to the tool body.

In some embodiments, an abrasive disk couples to the axial end face of the tool attachment. The abrasive disk can permanently couple to the axial end face, or the abrasive disk can be replaceable, e.g., using an appropriate attachment means.

For instance, in some embodiments, the tool attachment also comprises an abrasive disk holder having an aperture therethrough. In an example embodiment, the abrasive disk holder is detachably connectable to the axial end face such that the aperture aligns with the lug receiving opening. The detachable abrasive disk holder has a surface for attaching an abrasive disk to the axial end face of the tool body. Here, an abrasive disk can be attachable to the abrasive disk holder, or the abrasive disk can be permanently attached to the abrasive disk holder.

In other embodiments, the abrasive disk holder is not detachable. For instance, some embodiments include an abrasive disk that is permanently attached to the abrasive disk holder, whereas other embodiments comprise an abrasive disk that is attachable and removeable from the abrasive disk holder. Regardless of configuration, the abrasive disk is configured to clean at least one of a wheel hub and a lug. Moreover, in embodiments where an abrasive disk is replaceable, the abrasive disk can attach to the tool attachment, e.g., via the axial end face, via a fixed abrasive disk holder (e.g., structure on the axial end face), or via a detachable abrasive disk holder, which allows abrasive disks to be swapped out as the abrasive disk wears out.

The tool attachment also comprises a central bore that extends from the chamber of the cleaning end into the arm portion of the tool body such that a lug can be passed through the lug receiving opening, through the chamber, and into the central bore.

According to yet further aspects of the present disclosure, a tool attachment for cleaning wheel hub components comprises a tool body having a drive end, a cleaning end, and an arm portion extending between the drive end and the cleaning end. The cleaning end further comprises an axial end face, a lug receiving opening extending into the tool body through the axial end face, and a chamber within the cleaning end of the tool body. The chamber has a diameter that is greater than a diameter of the lug receiving opening. The cleaning end also comprises an abutment member aligned in an axial direction along an interior side wall of the chamber.

In some embodiments, the tool attachment also comprises a detachable abrasive disk holder. The detachable abrasive disk holder has an aperture therethrough and is detachably connectable to the axial end face of the tool body such that the aperture aligns with the lug receiving opening. The detachable abrasive disk holder has a surface for attaching an abrasive disk to the axial end face of the tool body.

Moreover, an abrasive disk can be attached to the axial end face, e.g., via the detachable abrasive disk holder. The abrasive disk has a disk aperture that extends therethrough such that when installed on the abrasive disk holder, the disk aperture aligns with the abrasive disk holder aperture. Here, the abrasive disk has a first abrasive surface on a major face of the abrasive disk and a second abrasive surface defining the side walls of the disk aperture.

DETAILED DESCRIPTION

Figure 1:
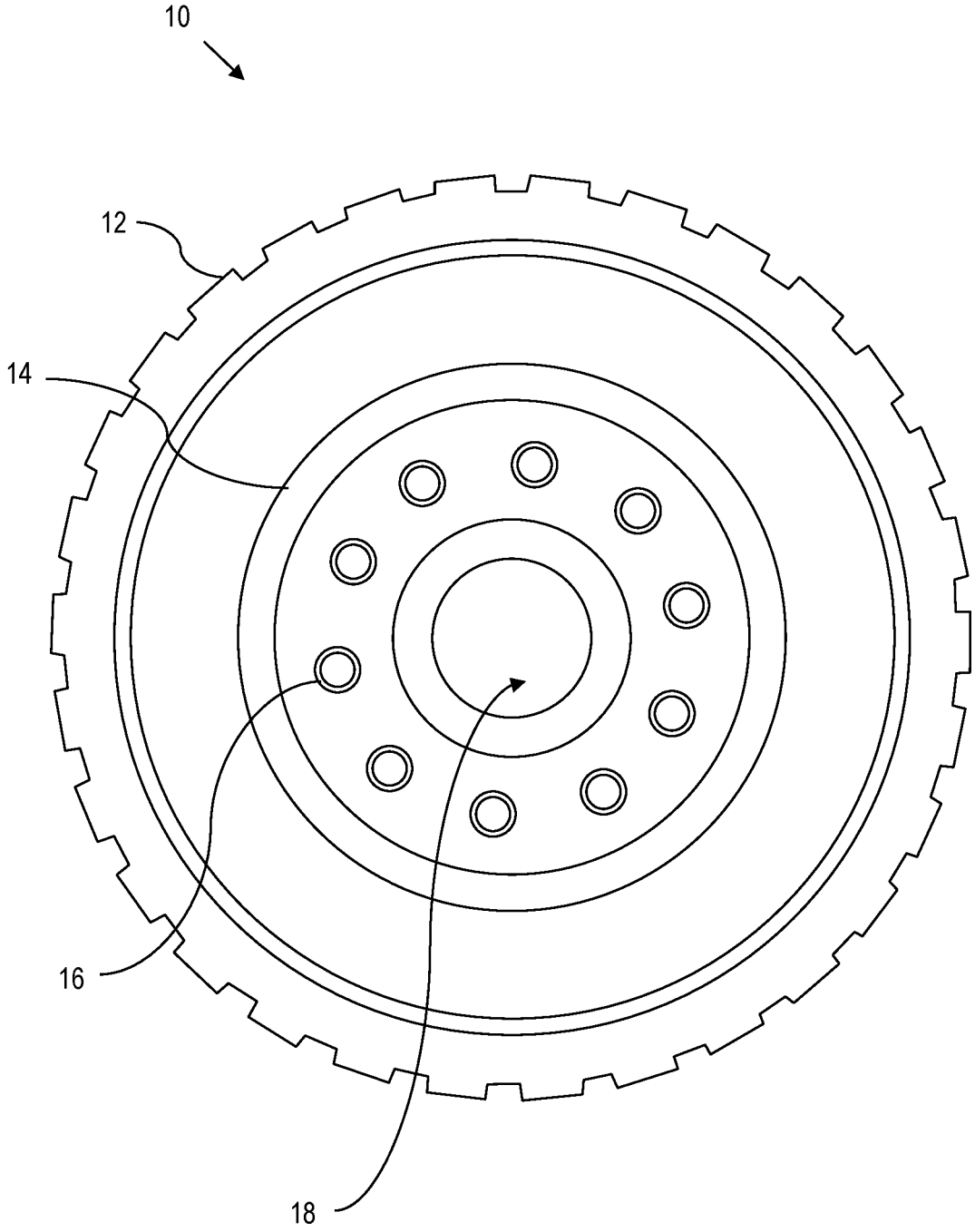
FIG. 1 is an illustration of an example wheel including a tire and a rim.

Referring generally to the drawings, and in particular to FIG. 1, a wheel 10 comprises generally, a tire 12 and a rim 14. The rim 14 comprises lug holes 16 that are distributed along a circumference radially spaced from a hub opening 18.

Figure 2:
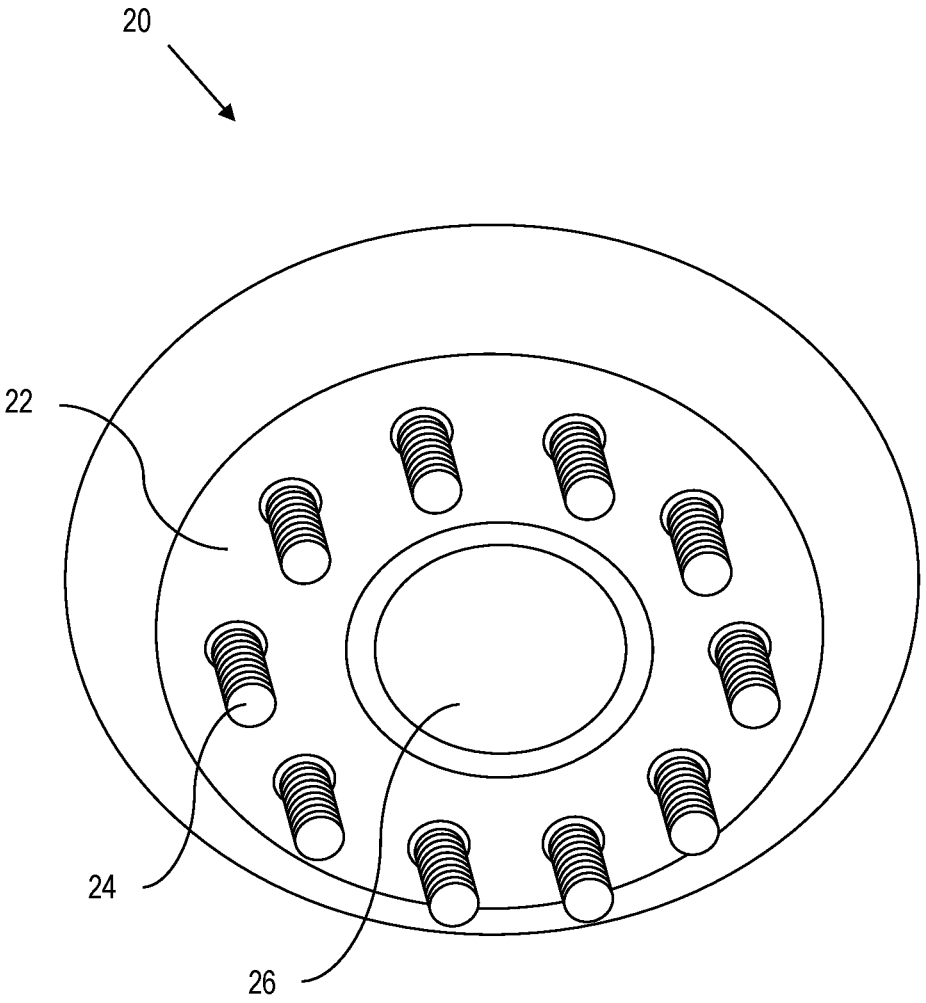
FIG. 2 is an illustration of an example hub flange and lug studs, according to aspects herein.

Referring to FIG. 2, a hub assembly 20 includes hub components, including a hub flange 22, and lugs 24. The lugs 24 are threaded studs that extend orthogonally outward from a face of the hub flange 22. Moreover, the lugs 24 are distributed along a circumference radially spaced from a central hub portion 26.

Referring generally to FIG. 1 and FIG. 2, when the wheel 10 is installed on the hub assembly 20, the lug holes 16 of the wheel 10 align with the lugs 24 of the hub assembly 20. Also, the hub opening 18 of the wheel 10 is engaged with the central hub portion 26 of the hub assembly 20. Typically, lug nuts (not shown) are secured over the threaded lugs to secure the wheel 10 to the hub assembly 20. Despite this tight mechanical coupling, over time, contaminants, e.g., dirt, grime, grease, debris, etc., can build up on the hub flange 22, in the threads of the lugs 24, and other hub and tire components.

Occasionally, a tire must be replaced, rotated, or otherwise serviced, which requires the wheel 10 to be removed from the hub assembly 20. Typically, removal of the wheel 10 from the hub assembly 20 reveals any built up contamination, e.g., dust, dirt, debris, rust, corrosion, etc., on the threaded studs and hub flange. Any such contamination should be cleaned before re-installing or replacing the wheel 10.

Tool Attachment

Figure 3:
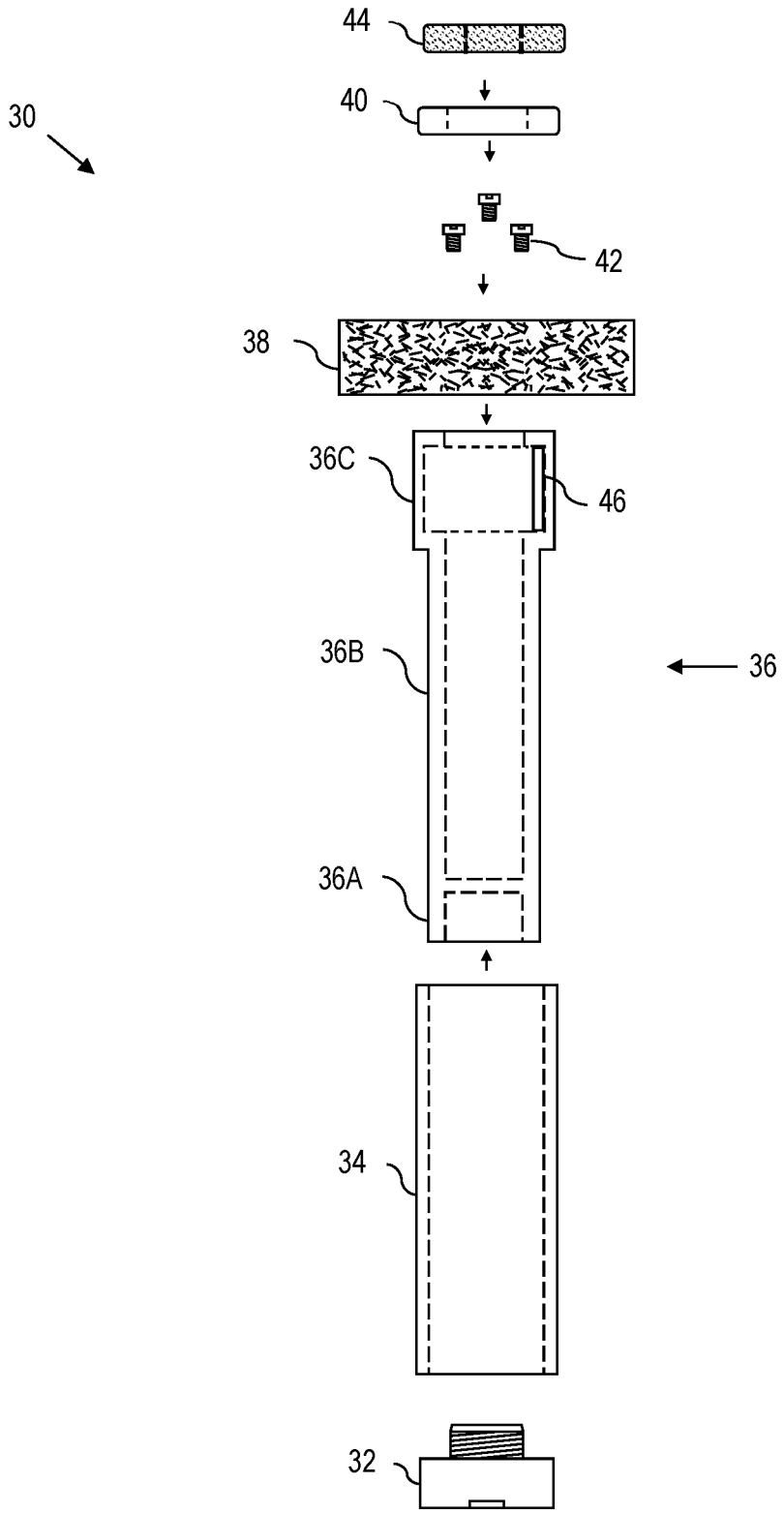
FIG. 3 is an exploded view of an embodiment of a tool attachment for cleaning wheel hub components, according to aspects herein.

Referring to FIG. 3, an exploded view illustrates a tool attachment 30 according to aspects of the present disclosure herein, which is suited to clean contamination from vehicle components, e.g., hub assembly 20 (FIG. 2) and components thereof. In particular, the tool attachment 30 provides a cleaning device that can quickly clean hub components, such as the hub flange 22, the lugs 24, or both (FIG. 2) even simultaneously. Moreover, the tool attachment 30 can be used to clean other components, such as a corresponding wheel rim 14 (FIG. 1).

The tool attachment 30 comprises in general, a tool body having a drive end and a cleaning end, where the cleaning end comprises an axial end face, a lug receiving opening extending into the tool body through the axial end face, and a chamber. A brush strip is within the chamber of the cleaning end.

More specifically, as illustrated, the tool attachment 30 comprises an optional tool coupler 32, an optional sleeve 34, a tool body 36, a brush strip 38 (which can be replaceable in some embodiments), an optional abrasive disk holder 40, one or more optional fasteners 42, and an abrasive disk 44.

The tool body 36 includes in general, a drive end 36A, an arm portion 36B, and a cleaning end 36C. In some embodiments, the tool coupler 32 is integral with the tool body 36, e.g., built into the drive end 36A. In other embodiments, the tool coupler 32 is attachable to, and detachable from the drive end 36A of the tool body 36, thus providing flexibility in the tools and tool types, that can drive the tool attachment 30. As will be described in greater detail herein, the tool coupler 32 can be configured to the specific tool used to drive the tool attachment 30, and can provide a plug, socket, or other configuration as necessary to couple to a corresponding power tool.

The brush strip is positioned within a chamber of the cleaning end 36C of the tool body 36. In some embodiments, an optional securement 46, e.g., a pin, wall, nub, extending surface, etc., is provided in the cleaning end. The optional securement 46 is useful in configurations where the brush strip is replaceable, e.g., to hold the ends of the replaceable brush strip 38 in place during use and/or to facilitate removal of a worn brush strip 38, as will be described in greater detail herein.

In some embodiments, the abrasive disk holder 40 has an aperture therethrough. For instance, as illustrated, the abrasive disk holder 40 is adjacent to the axial end face of the cleaning end 36C of the tool body 36, such that the aperture aligns with the lug receiving opening. The abrasive disk holder has a surface for attaching an abrasive disk to the axial end face of the tool body, examples of which are described in greater detail herein.

Tool Coupler

Figure 4:
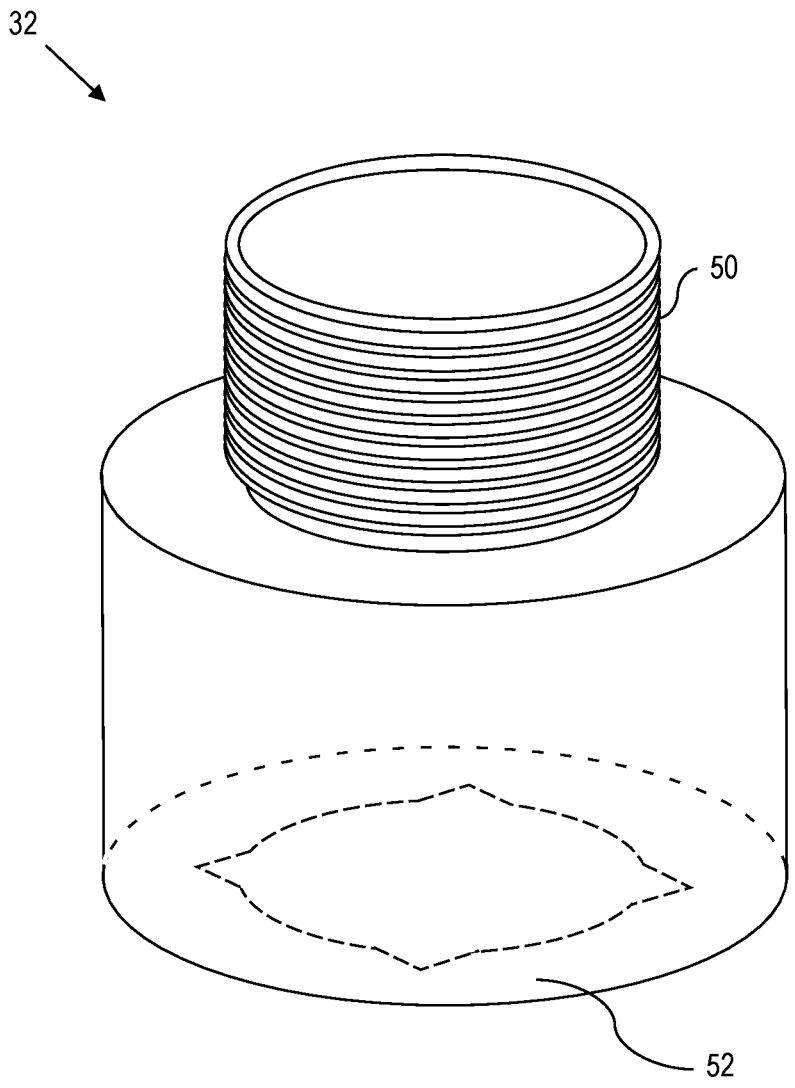
FIG. 4 is a perspective view of an example tool coupler for coupling the tool attachment to a power tool, according to aspects herein.
Figure 5:
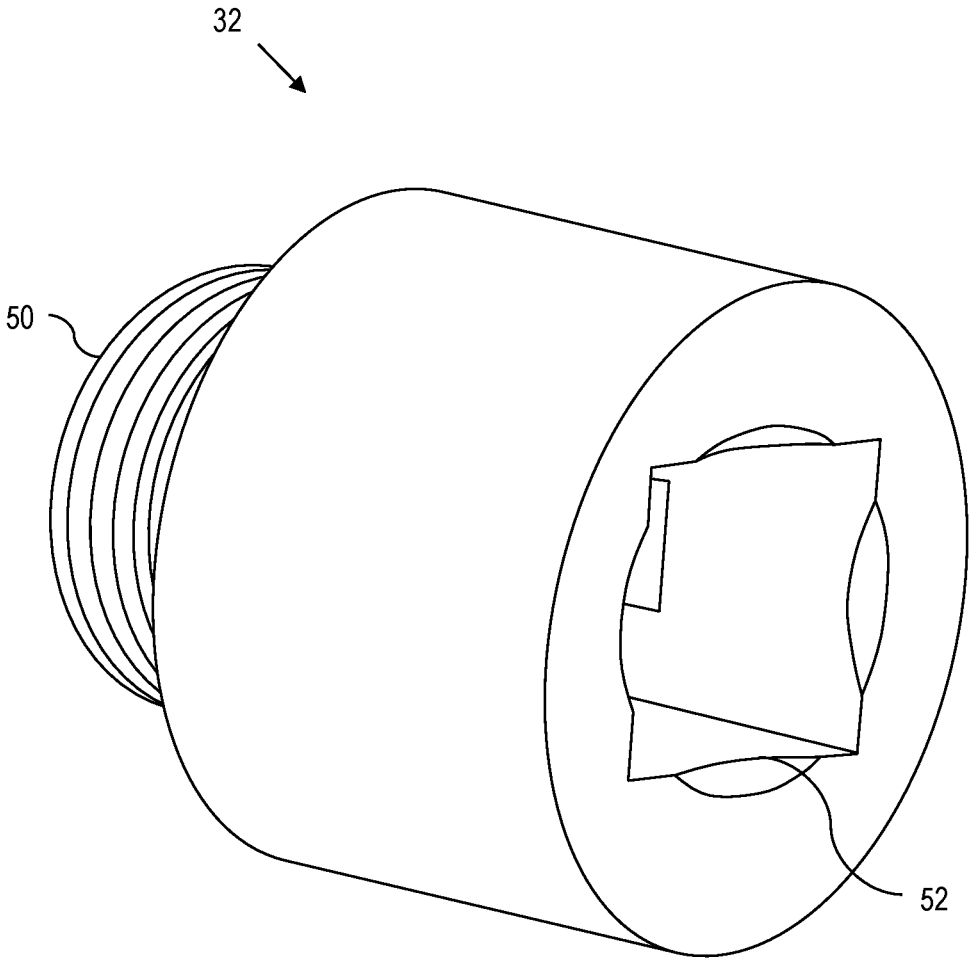
FIG. 5 is another perspective view of the tool coupler of FIG. 4.

Referring now to FIG. 4 and FIG. 5, an example implementation of the optional tool coupler 32 is illustrated. The illustrated tool coupler 32 includes a male threaded portion 50 that threads into the drive end 36A of the tool body 36 (FIG. 3). In this embodiment, the drive end 36A of the tool body 36 (FIG. 3) has corresponding female threads adapted to mate with the male threaded portion 50. As best illustrated in FIG. 5, the tool coupler 32 also comprises a tool engaging attachment 52 opposite the male threaded portion 50. The tool engaging attachment 52 will depend upon a tool that drives/rotates the tool body 36. For example, the tool engaging attachment 52 may comprise a cubic receptacle that accepts a drive head of a power tool such as an impact driver, socket wrench, etc. In this regard, the tool coupler 32 is detachably connectable to, and is adapted to mate with, a corresponding power tool (not shown). Moreover, the tool coupler 32 is detachably connectable to a drive end of the tool body 36 (FIG. 3).

Figure 6:
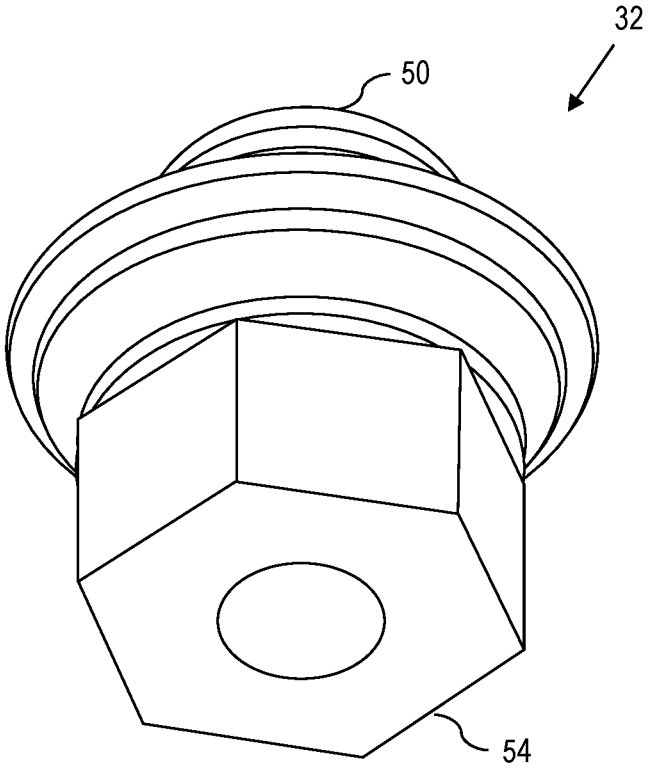
FIG. 6 is a perspective view of another example tool coupler according to aspects herein.
Figure 7:
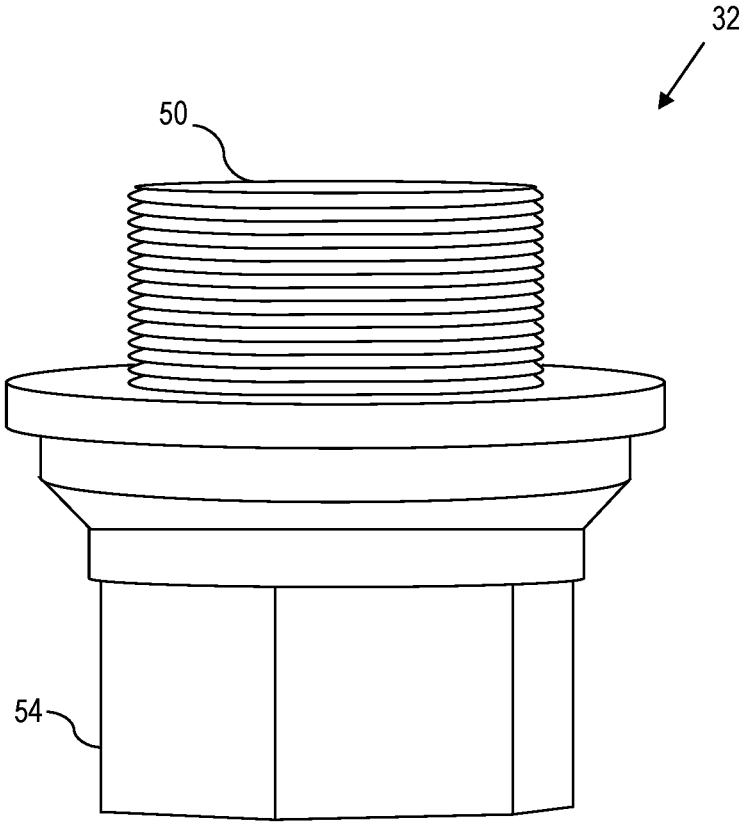
FIG. 7 is a side view of the example tool coupler of FIG. 14.

Referring to FIG. 6 and FIG. 7, another example tool coupler 32 is illustrated. This embodiment of the optional tool coupler 32 includes a male threaded portion 50 that threads into the drive end 36A of the tool body 36 (FIG. 3), analogous to that illustrated in FIG. 4 and FIG. 5. However, the tool coupler 32 also comprises a tool engaging attachment 54 opposite the male threaded portion 50. The tool engaging attachment 54 is illustrated as a hexagonal post. The use of a hexagonal post allows the tool coupler 32 to be received into a corresponding socket of a drive tool (not shown). If the hexagonal post is dimensioned appropriately, the tool coupler 32 could also be received into a chuck of a tool, e.g., a drill.

In alternative embodiments, the male threaded portion 50 of the tool coupler 32 could be replaced with a female threaded portion that is received by a mating male threaded portion of the tool body 36. In yet other alternative embodiments, other attachment means can be utilized to temporarily mechanically secure the tool coupler 32 to the tool body 36. Likewise, FIG. 4-FIG. 7 illustrate example ways to attach the tool coupler 32 to a corresponding power tool. However, the illustrated tool couplers 32 are presented by way of example and not by way of limitation. Other tool engaging attachment means can be utilized, the shape and configuration of which will depend upon the power tool selected to drive/rotate the tool attachment 30.

Moreover, it is possible to have multiple different tool couplers 32, e.g., each tool coupler instance configured to temporarily secure the tool body 36, but each having a different shaped configuration of tool engaging attachments, e.g., to mate with different rotary tools.

Sleeve

Referring briefly to FIG. 3, as noted above, the tool body 36 includes an arm portion 36B between the drive end 36A and the cleaning end 36C. In this regard, the sleeve 34 (when utilized) extends over the arm portion 36B. Here, the sleeve defines a holding surface that allows the tool attachment 30 to be held while the tool coupler 32 and/or drive end 36A of the tool body 36 is rotated.

Figure 8:
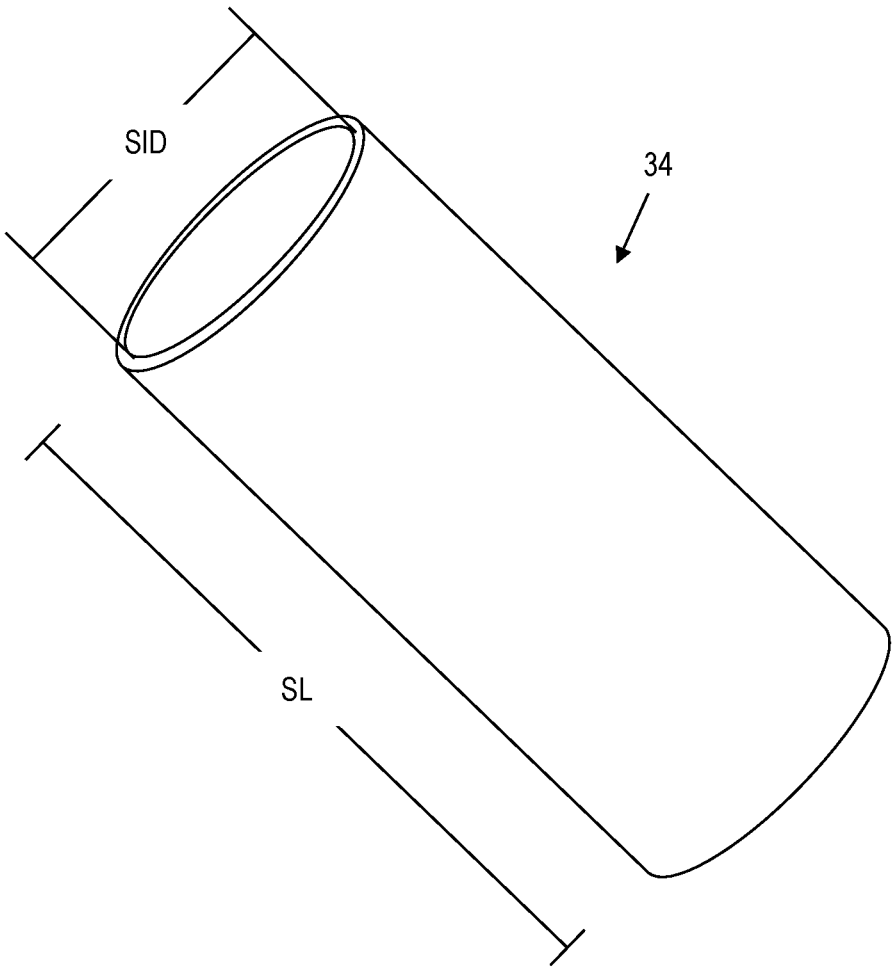
FIG. 8 is an example of an optional sleeve for providing a hand grip when using the tool attachment according to aspects herein.

Referring now to FIG. 8, an example illustrated sleeve 34 provides a handle that can be held by a user. The sleeve 34, e.g., Delrin, nylon, etc., is a tube having a sleeve inside diameter (SID) that fits loosely over an outside diameter of the arm portion 36B of the tool body 36 so that as the tool body 36 rotates, the sleeve 34 slips. This allows a user to hold the sleeve 34 stationary while the tool body 36 rotates therein. The sleeve 34 is further illustrated as having a sleeve length (SL) that is configured to fit over at least a section of the arm portion 36B of the tool body 36. In this regard, the shape and configuration of the tool body 36 will dictate the sleeve length SL. For instance, in some embodiments, the tool body 36 is configured in a small form factor that is not intended to be held or guided. In this instance, the sleeve 34 may be eliminated. In other applications, the sleeve length SL, and correspondingly a length of a corresponding portion of the tool body 36 can be configured based upon tire lug size to be cleaned, convenient size to hold, or other suitable factors.

Tool Body

Figure 9:
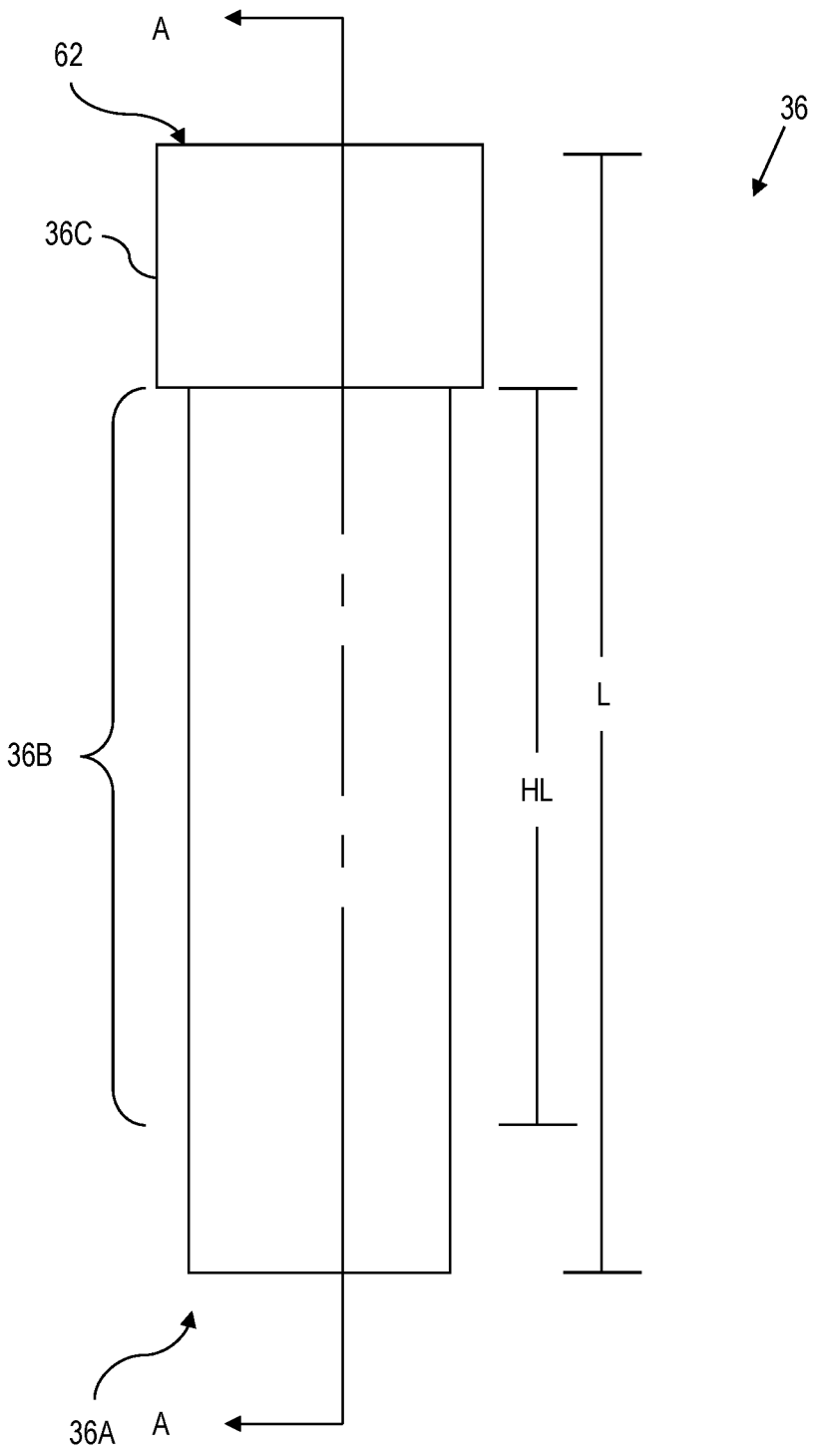
FIG. 9 is a side view of an example tool attachment body according to aspects herein.
Figure 10:
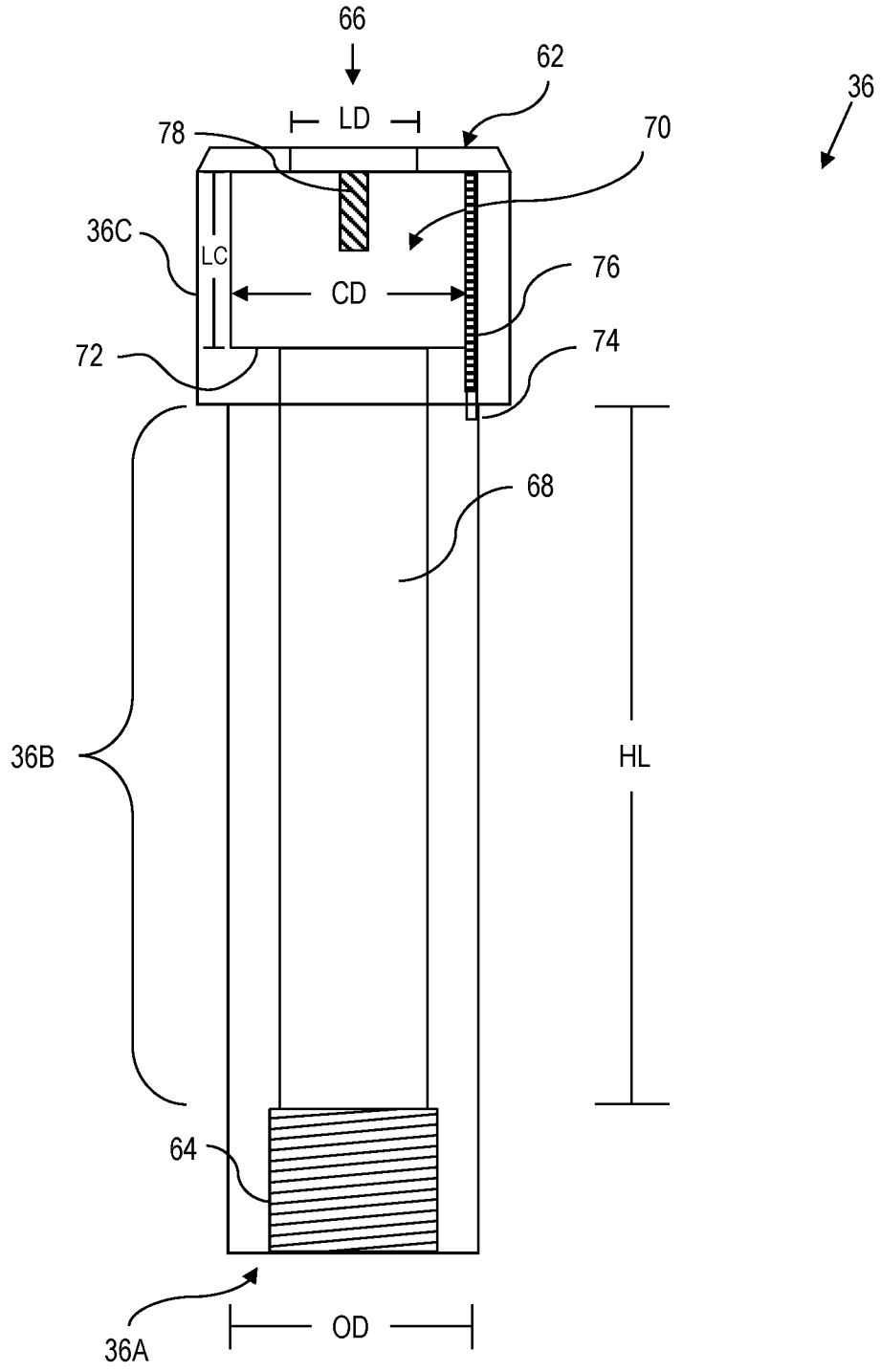
FIG. 10 is a cross-sectional view of the tool body of FIG. 9, according to aspects herein.
Figure 11:
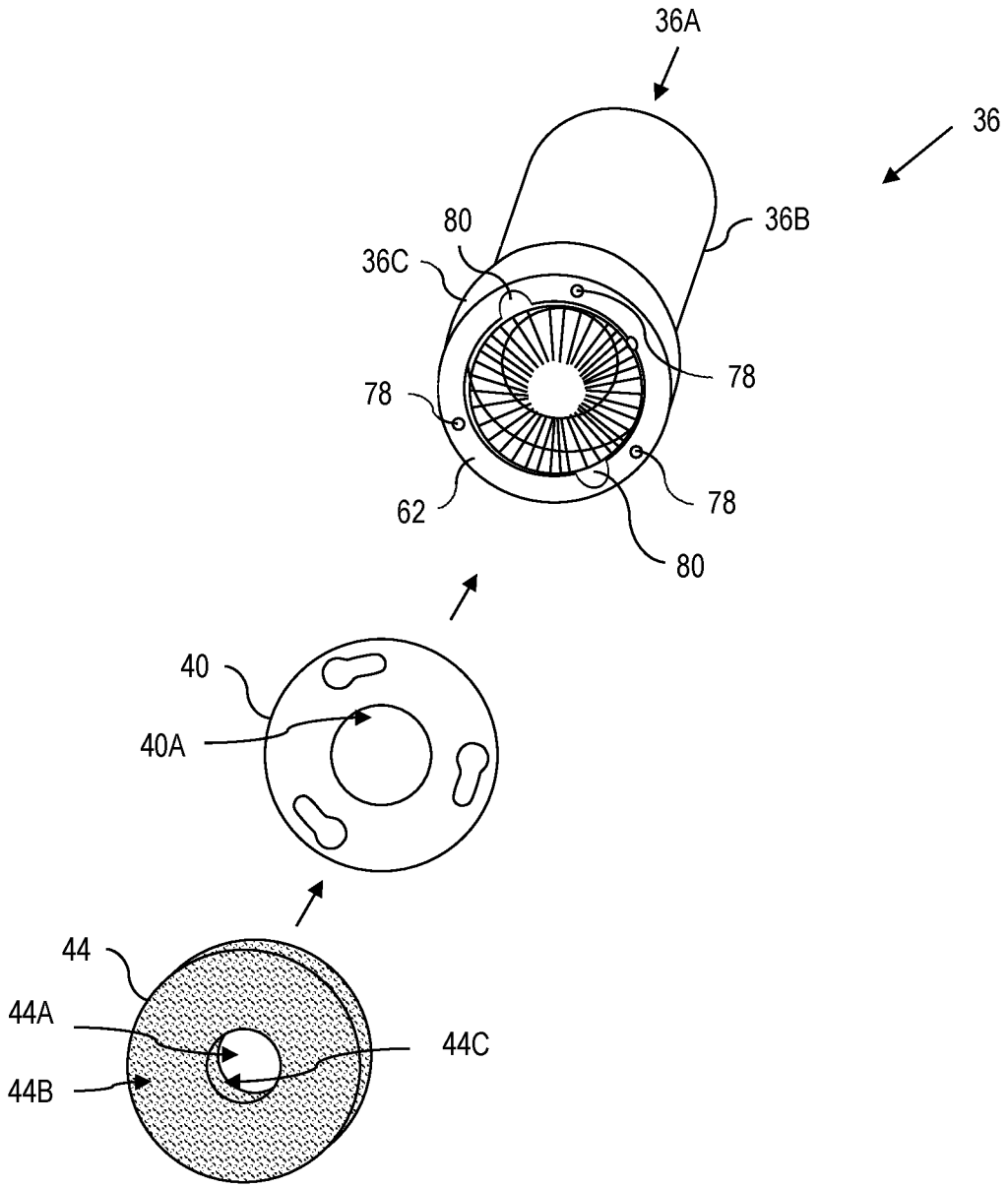
FIG. 11 is an exploded perspective view of the tool body of FIG. 9, according to aspects herein.

Referring to FIG. 9, FIG. 10, and FIG. 11, the tool body 36 is illustrated in greater detail. Particularly, FIG. 9 is a side view of the tool body 36, and in FIG. 10, the tool body 36 is illustrated in a cutout view taken along line A-A of FIG. 9. FIG. 11 is a perspective exploded view of the tool attachment, shown for clarity of discussion.

As best illustrated in FIG. 9, the illustrated tool body 36 includes a length (L) that extends in an axial direction. Moreover, the tool body 36 includes a drive end 36A, an arm portion 36B, and a cleaning end 36C. As noted above, the optional tool coupler 32 (FIG. 3) attaches to the tool body 36 via the drive end 36A. Thus, the tool coupler 32 can be connected to a power tool, e.g., impact wrench, lug wrench, etc., such that rotation caused by the power tool causes rotation of the tool coupler 32, which, in turn, causes rotation of the tool body 36. Alternatively, the drive end 36A can be configured to directly mate with a corresponding power tool.

The arm portion 36B of the tool body 36 receives the optional sleeve 34 (where utilized). In such example embodiments, a handle length (HL) of the arm portion 36B should correspond with, e.g., be the same length or longer than, the corresponding sleeve length (SL) (FIG. 8) of the corresponding sleeve 34.

Also, as shown, the cleaning end 36C includes an axial end face 62. The axial end face 62 provides a surface to connect an abrasive disk, e.g., via an optional disk holder 40 (FIG. 3) as described more fully herein.

As best illustrated in FIG. 10, the drive end 36A of the tool body 36 can include a female threaded member 64 (e.g., a female threaded aperture) that extends into the drive end 36A of the tool body 36. The female threaded member 64, mates with the male threaded portion 50 of the various embodiments of the optional tool coupler 32, as described more fully herein. In alternative embodiments, the drive end 36A has a male threaded portion (e.g., where the optional tool coupler 32 has a corresponding female threaded end), or other attachment configuration. Still further, in some embodiments, the drive end 36A can include a tool engaging attachment integral therewith so that an optional coupler is not required, e.g., by including a hexagonal post, a cubic receptacle that accepts a drive head of a power tool such as an impact driver, socket wrench, etc.

Moreover, the drive end 36A and arm portion 36B of the tool body 36 have an outside diameter (OD). In practical applications, the outside diameter (OD) can be generally tubular in shape. Moreover, where a sleeve 34 is provided, the sleeve inside diameter (SID) should allow the sleeve 34 to fit over the outside diameter (OD) of the drive end 36A and arm portion 36B of the tool body 36, enabling the tool body 36 to rotate within the sleeve 34.

Cleaning Features

As best illustrated in FIG. 10, the cleaning end 36C of the tool body 36 comprises an axial end face 62. A lug receiving opening 66 extends through the axial end face 62 into the cleaning end 36C of the tool body 36. In practical applications, the lug receiving opening 66 is aligned coaxially with the tool body 36. Moreover, the lug receiving opening 66 can be generally cylindrical in shape.

In some embodiments, the lug receiving opening 66 transitions through the cleaning end 36C into a central bore 68, e.g., at least partially into/through the arm portion 36B of the tool body 36. The central bore 68 is dimensioned such that a lug can recess into the tool body 36, even into the arm portion 36B in some embodiments. This allows the tool attachment 30 to clean lugs of various length. In this regard, the length (L) of the tool body 36 (FIG. 9) should be selected to correspond with the maximum expected lug length so that the tool body 36 can slip entirely over lug to be cleaned.

Referring specifically to FIG. 10, the cleaning end 36C includes a chamber 70 that is configured to hold a brush strip 38. In some embodiments, the chamber 70 temporarily holds a replaceable brush strip 38 (FIG. 3). As illustrated, the lug receiving opening 66 opens into the chamber 70. Moreover, the chamber 70 can neck down and open into the central bore 68, thus providing a continuous passageway into the tool body 36.

The chamber 70 has a chamber diameter (CD) that is greater than a lug diameter (LD) of the lug receiving opening 66. This is also clarified by the dashed lines in FIG. 3. As such, in some embodiments, to install the replaceable brush strip 38 into the cleaning end 36C of the tool body 36, a user can roll the replaceable brush strip 38 to have a diameter smaller than the LD of the lug receiving opening 66. The replaceable brush strip 38 can then be inserted through the lug receiving opening 66. When the user releases the replaceable brush strip 38, the replaceable brush strip 38 will unfurl or otherwise unroll, thus conforming to the inner wall defined by the chamber 70. In this regard, the axial end face 62, which is integral with the tool body 36, provides a first locking feature that prevents the replaceable brush strip 38 from detaching from the tool body 36 or otherwise coming out of position once installed. In this embodiment, because the axial end face 62 defines a lug diameter opening LD that is smaller than the chamber diameter CD, there is no need for a cap or other detachable element that would otherwise be necessary to secure the replaceable brush strip 38 within the chamber 70.

The central bore 68 (where provided), has a diameter generally similar to the lug diameter (LD) of the lug receiving opening 66. As such, the cleaning end 36C has an internal face 72 opposite the axial end face 62. The internal face 72 provides a second locking feature that prevents the replaceable brush strip 38 from detaching from the tool body 36 or otherwise coming out of position once installed.

A length of the chamber 70 (LC) should correspond to a width of the replaceable brush strip 38. Moreover, a circumference of the chamber 70 should correspond with a length of the replaceable brush strip 38. This allows the replaceable brush strip 38 to sit in the chamber 70 and wrap around an inner side wall of the chamber 70.

In some embodiments, there may not be enough friction between the replaceable brush strip 38 and the inner side wall of the chamber 70 to keep the replaceable brush strip 38 rotating with the tool body 36 under the force of contact between the replaceable brush strip 38 and a corresponding lug to be cleaned. In this regard, a securement (e.g., analogous to the securement 46—FIG. 3) can be used to hold the replaceable brush strip 38 in place. For instance, in an illustrative example embodiment, a receiver 74 is provided axially extending into the cleaning end 36C through the internal face 72, adjacent to the inner side wall of the chamber 70. A corresponding pin 76 is positioned in the receiver 74. The pin 76 extends axially along the inner side wall of the chamber 70. The pin 76 provides an abutment member having surfaces that engage opposing ends of the replaceable brush strip 38. That is, a first edge of the replaceable brush strip 38 engages a first side edge of the abutment member (e.g., the pin 76 as illustrated). The replaceable brush strip 38 wraps around the inner side wall of the chamber 70, and a second edge, opposite the first edge, of the replaceable brush strip 38 engages a second side of the abutment member (e.g., the pin 76 as illustrated). This prevents the replaceable brush strip 38 from slipping relative to the tool body 36 during use.

Notably, the shape of the internal volume of the cleaning end 36C of the tool body 36 include features that secure the replaceable brush strip 38 in the tool body 36 such that a cap or other structure is unnecessary to hold the replaceable brush strip 38 in place. For instance, the axial end face 62 cooperates with the internal face 72 to create abutments that prevent the replaceable brush strip 38 from backing out of the tool body 36 or otherwise coming out of position. Alternatively and/or additionally, inward tabs or nubs can be formed in the side wall of the lug receiving opening 66 to temporarily and mechanically lock the replaceable brush strip 38 in place.

In other embodiments, the brush strip 38 can be permanently installed, or otherwise integral with the tool body 36. Here, when the brushes of the brush strip 38 are worn out, the entire tool can be replaced.

With specific reference to FIG. 11, also illustrated, the axial end face 62 includes optional tab openings 80. The tab openings 80 make it relatively easier for a user to reach into the chamber 70 to remove the replaceable brush strip 38 so that a new replaceable brush strip 38 can be inserted therein.

Referring now to FIG. 10 and FIG. 11, in some embodiments, arrayed around the axial end face 62 are threaded inserts 78. The threaded inserts 78, e.g., female threaded members, receive the fasteners 42 (FIG. 3) such as shoulder bolts, screws, studs, etc., to secure the abrasive disk holder 40 to the tool body 36.

Notably, as best illustrated in FIG. 11, in some embodiments, an abrasive disk holder 40 is provided. The illustrated abrasive disk holder 40 includes an disk holder aperture 40A that extends therethrough. Correspondingly, the abrasive disk 44 includes a disk aperture 44A that extends therethrough such that when installed on the abrasive disk holder 40, the disk aperture 44A aligns with the abrasive disk holder aperture 40A, which aligns with the lug diameter opening LD (FIG. 10) in the tool body 36. Moreover, the abrasive disk 44 has a first abrasive surface 44B on a major face of the abrasive disk 44 and a second abrasive surface 44C defining the side walls of the disk aperture. In some embodiments, the disk aperture 44A of the abrasive disk 44 is smaller than the aperture 40A of the disk holder.

Thus, in use, when the tool attachment is first brought into contact with a lug 24 (FIG. 2), the second abrasive surface 44C begins cleaning debris. As the tool attachment is extended over the lug, the wire brushes of the brush strip 38 also begin cleaning the lug 24. Once the lug 24 is engulfed by the tool body 36, the first abrasive surface 44B begins cleaning the hub flange 22 (FIG. 2). The second abrasive surface 44C cleans the lug closest to the hub flange, and the wire brushes clean the remainder of the lug.

Replaceable Brush Strip

Figure 12:
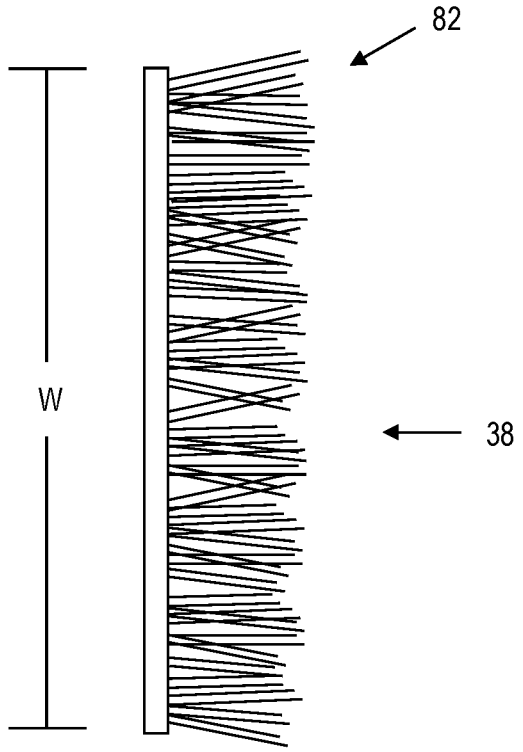
FIG. 12 is a side view of an example replaceable brush strip according to aspects herein.

Referring to FIG. 12, an example embodiment of a replaceable brush strip 38 is illustrated. The replaceable brush strip 38 comprises a generally rectangular strip that includes brushes 82 that extend therefrom. With reference to FIG. 10 and FIG. 12 generally, as noted more fully herein, the replaceable brush strip 38 is releasably secured about an inner side wall of the chamber 70 (FIG. 10). Thus, the replaceable brush strip 38 has a length (into the page as shown) that corresponds generally to a circumference of inner side wall of the chamber 70. Correspondingly, the replaceable brush strip 38 has a width (W) that corresponds generally to LC (FIG. 10), i.e., a length/height of the inner side wall of the chamber 70. Thus, in operation, the chamber 70 has a depth that accommodates the replaceable brush strip 38. The brushes 82 define bristles that clean debris from a lug as the lug is inserted through the lug receiving opening 66 into the chamber 70 and the tool body 36 is rotated relative to the lug. When the brushes 82 wear out, the brush strip 38 is merely pried out of the chamber 70 through the lug receiving opening 66, and a new replaceable brush strip 38 is installed therein as described more fully above.

Hub Cleaning Abrasive Pad

Figure 13:
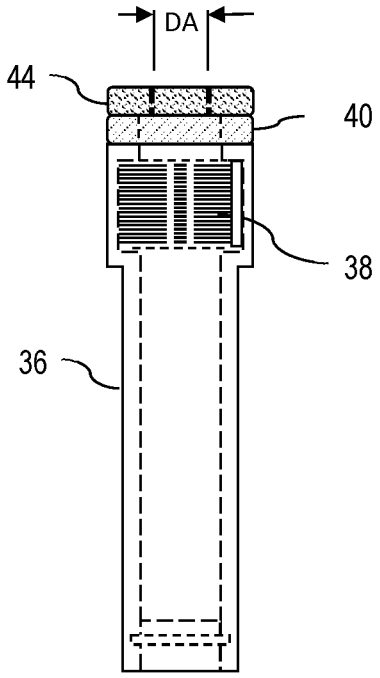
FIG. 13 is a cross-sectional view of an embodiment of a tool body with the brush strip therein, according to aspects herein.
Figure 14:
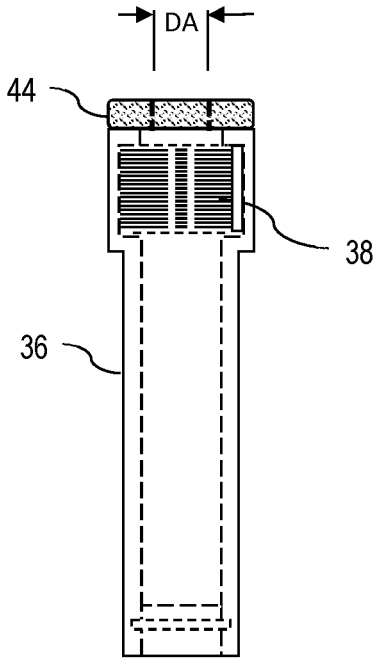
FIG. 14 is a cross-sectional view of another embodiment of a tool body with the brush strip therein, according to aspects herein.

Referring now to FIG. 13 and to FIG. 14 generally, an abrasive disk 44 is shown attached to the tool body 36. This allows the tool attachment 30 to have the ability to clean a hub component, e.g., a hub flange independent of cleaning a lug, or simultaneous with cleaning a lug. Moreover, this configuration allows cleaning an entirety of a lug. As will be described in greater detail below, regardless of embodiment, in some configurations, the abrasive disk 44 is permanently attached to the axial end face of the tool body. In other embodiments, the abrasive disk 44 is detachably secured to the axial end face. This allows the abrasive disk 44 to be replaced if/when the abrasive disk wears out.

Referring to FIG. 13, in some embodiments, the axial end face can include an attachment that receives and (optionally temporarily) holds the abrasive disk 44 to the axial end face. This can be carried out by example, via screws, clips, adhesive, an abrasive disk holder, combinations thereof, etc. For instance, FIG. 13 illustrates the abrasive disk 44 coupled to the axial end face of the tool body via an abrasive disk holder 40.

In some embodiments, the abrasive disk holder 40 is detachable from the axial end face of the tool body. This allows ready removal of the abrasive disk holder 40 (and hence, the abrasive disk 44) from the tool body 36 to facilitate quick changeover of abrasive pads of the abrasive disk 44. In other embodiments, the abrasive disk holder 40 is permanently fixed to the axial end face of the tool body.

In some embodiments, the abrasive disk 44 is replaceable from (i.e. can temporarily attach to) a corresponding abrasive disk holder 44. This allows replacement of the abrasive disk 44 while keeping and/or re-using the abrasive disk holder 40. Here, the abrasive disk holder 44 can be detachable from the axial end face of the tool body, or the abrasive disk holder 44 can be fixed to the axial end face of the tool body.

In some embodiments, the abrasive disk 44 is permanently attached to the abrasive disk holder 40 such that the abrasive disk holder 40 and abrasive disk 44 are a pair. In embodiments where the abrasive disk 44 is replaceable, the abrasive disk holder 40 and abrasive disk 44 are replaced a s a pair. In other embodiments, where the abrasive disk holder 40 and abrasive disk 44 are fixed to the axial end face of the tool body, the entire tool attachment may be replaced when the abrasive disk 44 wears out.

Correspondingly, FIG. 14 illustrates the abrasive disk 44 directly coupled to the axial end face of the tool body. In some embodiments, the abrasive disk 44 can temporarily attach to the axial end face of the tool body 36 using adhesive, hook and loop fastener, tack, screws, bolts, combinations thereof, etc. In other embodiments, the abrasive disk 44 can permanently attach to the axial end face of the tool body 36. Otherwise, the embodiment in FIG. 14 is analogous to the embodiment of FIG. 13.

Figure 15:
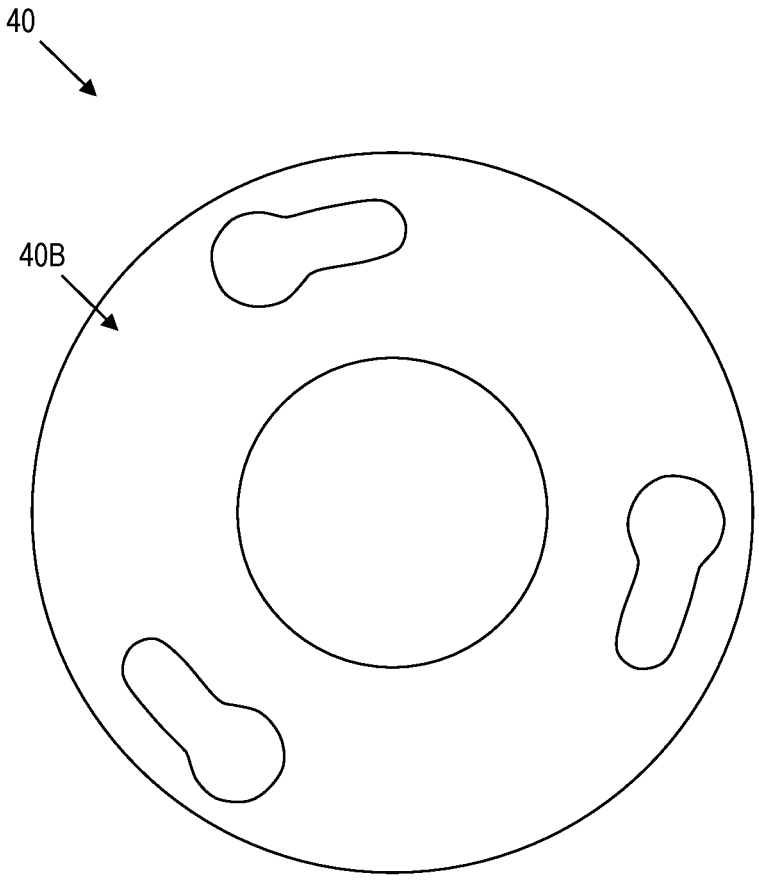
FIG. 15 is an example of a back side of an abrasive disk holder, according to aspects herein.
Figure 16:
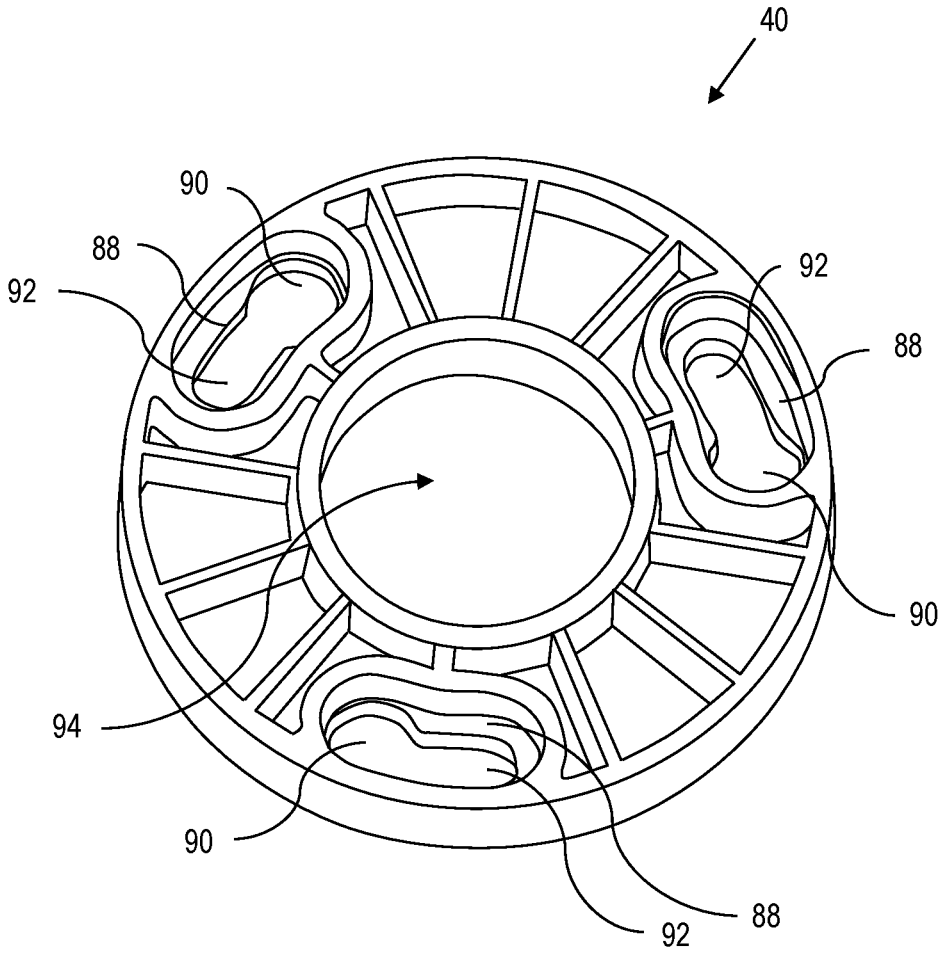
FIG. 16 is an example of a front side of the abrasive disk holder of FIG. 14.

Referring to FIG. 15 and to FIG. 16, an example abrasive disk holder 40 is illustrated. As illustrated in FIG. 15, in example embodiments, a detachable abrasive disk holder 40 includes a smooth surface 40B for coupling to the axial end face of the tool body 36 (not shown).

Referring to FIG. 16, the detachable abrasive disk holder 40 of FIG. 15 is shown on the face opposite the smooth face 40B. As shown in FIG. 16, the abrasive disk holder 40 also includes locking slots 88 that allow the detachable abrasive disk holder 40 to quickly release from the fasteners 42 (e.g., shoulder bolts) by inserting the detachable abrasive disk holder 40 over receiving apertures 90 of the locking slots 88, and twisting the detachable abrasive disk holder 40 into receiving channels 92 of the locking slots 88 thereby pinching the detachable abrasive disk holder 40 between the tool body 36 and the heads of the fasteners 42. Moreover, in some embodiments, the locking slots 88 can include ramps so that as the abrasive disk holder 40 is rotated, the abrasive disk holder 40 tightens between the heads of the fasteners 42 (e.g., shoulder bolts) and the axial end face 62 of the tool body 36.

The abrasive disk holder 40 has a surface for attaching the abrasive disk 44 to the axial end face of the tool body 36, e.g., via temporary attachment such as adhesive, hook and loop securements, via permanent attachment, etc. In this regard, rotation of the tool body 36 rotates the abrasive disk 44, providing the ability to clean a surface, e.g., a hub flange.

Figure 17:
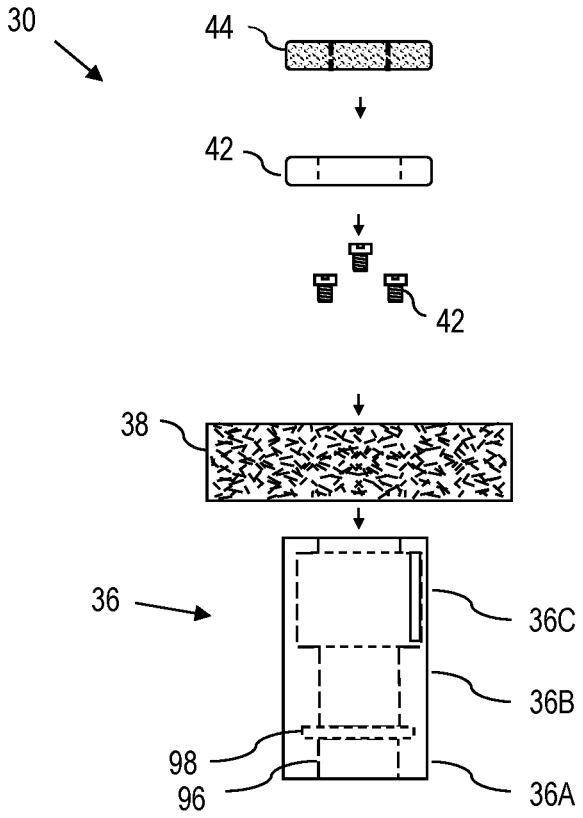
FIG. 17 is another example tool attachment according to aspects of the present disclosure herein.

Referring to FIG. 17, an exploded view illustrates another example tool attachment 30 according to aspects of the present disclosure herein, which is suited to clean contamination from vehicle components such as lugs, hubs, etc. In particular, the tool attachment 30 provides a cleaning device that can quickly clean hub components, such as the hub flange 22, the lugs 24, or both (FIG. 2) even simultaneously. Moreover, the tool attachment 30 can be used to clean other components, such as a corresponding wheel rim 14 (FIG. 1).

The tool attachment 30 is analogous to previously described embodiments. That is, the tool attachment 30 includes a tool body 36 having a drive end 36A, an arm portion 36B, and a cleaning end 36C. The cleaning end 36C includes a chamber for receiving a replaceable brush strip 38. Moreover, an optional disk holder 40 can be detachably connected to an axial end face of the tool body 36, e.g., via fasteners such as shoulder bolts. An abrasive disk 44 attaches to the disk holder 40 (or optionally directly to the axial end face of the tool body 36. In this regard, like elements are illustrated with like reference numbers, and the above descriptions can apply by analogy. Moreover, the embodiment of FIG. 17 can include any previously described features, and as such, only differences are further described.

Notably, the example embodiment is adapted to plug directly into a tool (not shown) and includes a tool socket 96 that receives a rotatable member of the corresponding tool. An undercut 98 or any other features can be provided in order to temporarily lock or otherwise secure the tool attachment 30 to the tool, e.g., when using an impact wrench, etc.

Figure 18:
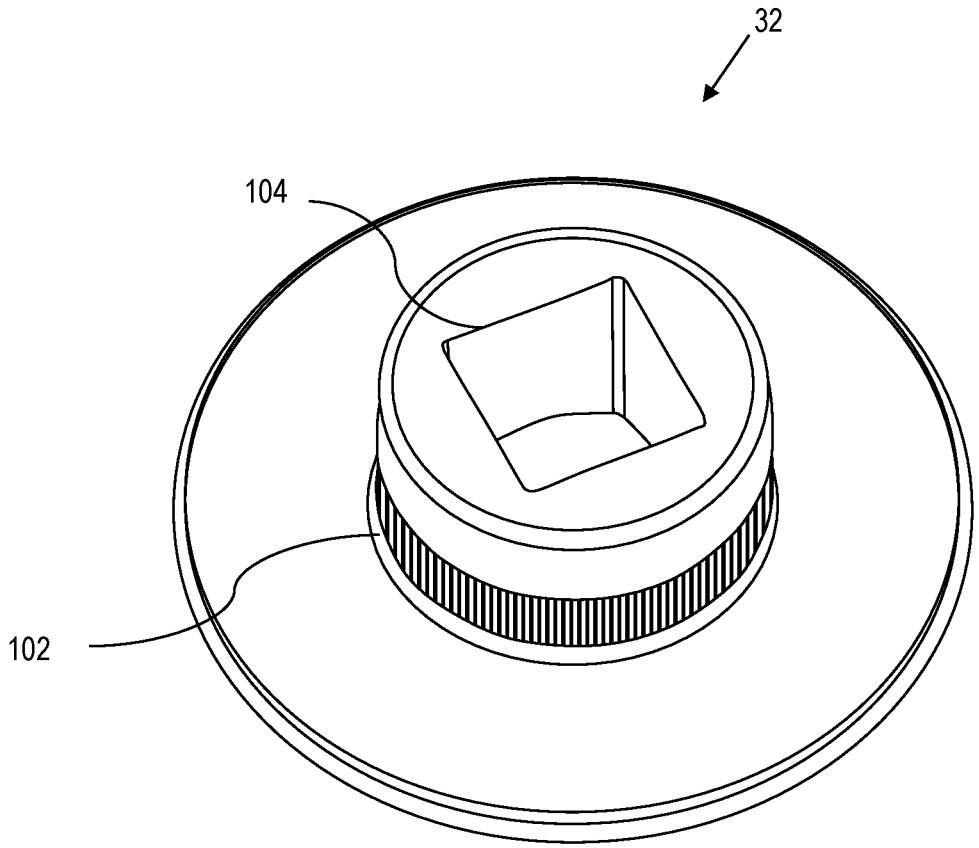
FIG. 18 is another example of a tool attachment end that enables the tool attachment to adapt for use with various power tools.

Referring now to FIG. 18, another example implementation of the optional tool coupler 32 is illustrated. The illustrated tool coupler 32 includes a knurled portion 102 that releasably secures into the drive end 36A of the tool body 36 (FIG. 3). In this embodiment, the drive end 36A of the tool body 36 (FIG. 3) has a corresponding surface adapted to mate with the knurled portion 102. This enables the tool coupler 32 to be quickly pressed on and popped off the tool attachment 30. The tool coupler 32 thus frictionally engages the tool attachment 30. The tool coupler 32 also includes a drive member 104 that engages a corresponding drive mechanism of a corresponding power tool. Thus, referring to the FIGURES generally, where a tool coupler 32 is utilized, in some embodiments, the tool coupler is detachably connectable to the drive end of the tool body by threadably connecting the tool coupler to the tool body. In other embodiments, the tool coupler is detachably connectable to the drive end of the tool body by connecting (e.g., via press fit, friction, etc.) the tool coupler to the tool body.

Referring to the FIGURES generally, in some embodiments, the abrasive disk holder 40 has an aperture therethrough that aligns with the lug receiving opening 66 of the tool body 36. Abrasive disks 44 also have a corresponding aperture. This allows a lug to pass through the abrasive disk holder 40 and recess into the chamber 70 containing the replaceable brush strip 38, allowing the simultaneous cleaning of a lug (via the brushes 82 of the replaceable brush strip 38) and cleaning of a hub flange and lug (via the abrasive disk 44).

Referring generally to the FIGURES, various aspects, e.g., embodiments, configurations, features, functions, etc., have been described herein. In this regard, any one or more aspects described with reference to any FIGURE can be combined with, added to, or replaced with, any one or more aspects described with reference to any other FIGURE(S) to achieve various combinations of tool attachments.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. Aspects of the disclosure were chosen and described in order to best explain the principles of the disclosure and the practical application, and to enable others of ordinary skill in the art to understand the disclosure for various embodiments with various modifications as are suited to the particular use contemplated.

What is claimed is:

1. A tool attachment for cleaning wheel hub components, comprising:

a tool body having:
- a drive end;
- an arm portion comprising:
  - an arm portion outer diameter;
  - a first arm portion end that is located toward the drive end; and
  - a second arm portion end on an opposite end of the first arm portion end; and
- a cleaning end mechanically coupled to the second arm portion end, wherein the cleaning end comprises:
  - an axial end face;
  - a lug receiving opening extending into the tool body through the axial end face; and
  - a chamber;

a sleeve having a sleeve inner diameter that is larger than the arm portion outer diameter, wherein the sleeve fits over the arm portion to enable the tool body to rotate within the sleeve and permit a user to hold the sleeve stationary while the tool body rotates therein;

a brush strip within the chamber of the cleaning end, the brush strip for cleaning a lug;

fasteners arrayed around and secured to the axial end face, each fastener comprising a corresponding fastener head, the fasteners being configured to secure an abrasive disk holder to the tool body;

the abrasive disk holder comprising:
- locking slots, each locking slot comprising:
  - a receiving aperture for receiving a corresponding fastener head of a corresponding fastener; and
  - a receiving channel through which the corresponding fastener head moves, thereby securing the abrasive disk holder to the axial end face by pinching the abrasive disk holder between the tool body and the corresponding fastener head; and
- an aperture through the abrasive disk holder;

wherein the abrasive disk holder is connectable to the axial end face such that the aperture through the abrasive disk holder aligns with the lug receiving opening;

wherein a central bore extends from the chamber of the cleaning end into the arm portion of the tool body such that the lug can be passed through the lug receiving opening, through the chamber, and into the central bore;

the abrasive disk holder being secured adjacent to the axial end face by the fasteners such that the aperture through the abrasive disk holder aligns with the lug receiving opening, the abrasive disk holder having a surface for attaching an abrasive disk to the axial end face of the tool body, the abrasive disk for cleaning a wheel hub;

wherein the abrasive disk has a first abrasive surface on a major face of the abrasive disk and a second abrasive surface defining side walls of an abrasive disk aperture.

2. The tool attachment according to claim 1, wherein:

the abrasive disk aperture of the abrasive disk is smaller than the aperture of the abrasive disk holder.

3. The tool attachment according to claim 1 further comprising:

a tool coupler that is adapted to mate with a corresponding power tool, the tool coupler detachably connectable to the drive end of the tool body.

4. The tool attachment of claim 3, wherein the tool coupler is detachably connectable to the drive end of the tool body by threadably connecting the tool coupler to the tool body.

5. The tool attachment of claim 4, wherein the tool coupler includes a male threaded end that threadably connects to a corresponding female threaded aperture in the drive end of the tool body.

6. The tool attachment of claim 1, wherein:

the brush strip is a replaceable brush strip comprising a rectangular strip having bristles extending generally radially out from the rectangular strip.

7. The tool attachment of claim 6 further comprising:

an abutment member aligned in an axial direction along an interior side wall of the chamber; wherein:

when the replaceable brush strip is installed in the tool body, a first edge of the rectangular strip engages a first side of the abutment member, and a second edge, opposite the first edge, of the rectangular strip engages a second side of the abutment member, so as to prevent the replaceable brush strip to slip or otherwise rotate relative to the tool body.

8. The tool attachment according to claim 1, further comprising:

threaded inserts arrayed around the axial end face, each threaded insert being configured to receive a corresponding one of the fasteners.

9. A tool attachment for cleaning wheel hub components, comprising:

a tool body having a drive end, a cleaning end, and an arm portion extending between the drive end and the cleaning end, wherein the arm portion comprises an arm portion outer diameter, wherein the cleaning end comprises an axial end face, and a lug receiving opening extending into the tool body through the axial end face providing an opening into a chamber within the cleaning end of the tool body, wherein the chamber has a diameter that is greater than a diameter of the lug receiving opening;

a sleeve having a sleeve inner diameter that is larger than the arm portion outer diameter, wherein the sleeve fits over the arm portion to enable the tool body to rotate within the sleeve and permit a user to hold the sleeve stationary while the tool body rotates therein;

a brush strip within the chamber of the cleaning end, the brush strip for cleaning a lug;

fasteners arrayed around and secured to the axial end face, each fastener comprising a corresponding fastener head, the fasteners being configured to secure a detachable abrasive disk holder to the tool body;

the detachable abrasive disk holder comprising:

locking slots, each locking slot comprising:

a receiving aperture for receiving a corresponding fastener head of a corresponding fastener;

a receiving channel through which the corresponding fastener head moves, thereby securing the detachable abrasive disk holder to the axial end face by pinching the detachable abrasive disk holder between the tool body and the corresponding fastener head; and an aperture through the detachable abrasive disk holder;

wherein the detachable abrasive disk holder is detachably connectable to the axial end face such that the aperture through the detachable abrasive disk holder aligns with the lug receiving opening;

wherein a central bore extends from the chamber of the cleaning end into the arm portion of the tool body such that the lug can be passed through the lug receiving opening, through the chamber, and into the central bore;

the detachable abrasive disk holder being secured adjacent to the axial end face by the fasteners such that the aperture through the detachable abrasive disk holder aligns with the lug receiving opening, the detachable abrasive disk holder having a surface for attaching an abrasive disk to the axial end face of the tool body, the abrasive disk for cleaning a wheel hub;

wherein the abrasive disk has a first abrasive surface on a major face of the abrasive disk and a second abrasive surface defining side walls of an abrasive disk aperture.

10. The tool attachment of claim 9, wherein:

the brush strip comprises a replaceable brush strip that is releasably secured within the chamber of the cleaning end, the replaceable brush strip comprising a rectangular strip having bristles extending generally radially out from the rectangular strip.

11. The tool attachment of claim 10 further comprising:

an abutment member aligned in an axial direction along an interior side wall of the chamber; wherein:

when the replaceable brush strip is installed in the tool body, a first edge of the rectangular strip engages a first side of the abutment member, and a second edge, opposite the first edge, of the rectangular strip engages a second side of the abutment member, so as to prevent the replaceable brush strip to slip or otherwise rotate relative to the tool body.

12. The tool attachment according to claim 9 further comprising:

a tool coupler that is adapted to mate with a corresponding power tool, the tool coupler detachably connectable to the drive end of the tool body.

13. The tool attachment of claim 12, wherein the tool coupler is detachably connectable to the drive end of the tool body by threadably connecting the tool coupler to the tool body.

14. The tool attachment of claim 12, wherein the tool coupler includes a male threaded end that threadably connects to a corresponding female threaded aperture in the drive end of the tool body.

15. A tool attachment for cleaning wheel hub components, comprising:

a tool body having a drive end, a cleaning end, and an arm portion extending between the drive end and the cleaning end, the arm portion having an arm portion outer diameter, the cleaning end further comprising:

an axial end face;

a lug receiving opening extending into the tool body through the axial end face;

a chamber within the cleaning end of the tool body, the chamber having a diameter that is greater than a diameter of the lug receiving opening; and an abutment member aligned in an axial direction along an interior side wall of the chamber;

a sleeve having a sleeve inner diameter that is larger than the arm portion outer diameter, wherein the sleeve fits over the arm portion to enable the tool body to rotate within the sleeve and permit a user to hold the sleeve stationary while the tool body rotates therein;

a replaceable brush strip comprising a rectangular strip having bristles extending out from the rectangular strip, the replaceable brush strip for cleaning a lug;

fasteners arrayed around and secured to the axial end face, each fastener comprising a corresponding fastener head;

a detachable abrasive disk holder comprising:

locking slots, each locking slot comprising:

a receiving aperture for receiving a corresponding fastener head of a corresponding fastener;

a receiving channel through which the corresponding fastener head moves, thereby securing the detachable abrasive disk holder to the axial end face by pinching the detachable abrasive disk holder between the tool body and the corresponding fastener head; and an aperture through the detachable abrasive disk holder;

wherein the detachable abrasive disk holder is connectable to the axial end face such that the aperture through the detachable abrasive disk holder aligns with the lug receiving opening;

wherein a central bore extends from the chamber of the cleaning end into the arm portion of the tool body such that the lug can be passed through the lug receiving opening, through the chamber, and into the central bore;

the abrasive disk holder being secured adjacent to the axial end face by the fasteners such that the aperture through the detachable abrasive disk holder aligns with the lug receiving opening, the abrasive disk holder having a surface for attaching an abrasive disk to the axial end face of the tool body, the abrasive disk for cleaning a wheel hub;

wherein:

when the replaceable brush strip is installed in the tool body, a first edge of the rectangular strip engages a first side of the abutment member, and a second edge, opposite the first edge, of the rectangular strip engages a second side of the abutment member, so as to prevent the replaceable brush strip to slip or otherwise rotate relative to the tool body;

the abrasive disk has a disk aperture that extends therethrough such that when installed on the abrasive disk holder, the disk aperture aligns with the detachable abrasive disk holder aperture; and the abrasive disk has a first abrasive surface on a major face of the abrasive disk and a second abrasive surface defining side walls of the disk aperture.

16. The tool attachment according to claim 15 further comprising:

a tool coupler that is adapted to mate with a corresponding power tool, the tool coupler detachably connectable to the drive end of the tool body.

17. The tool attachment of claim 15, wherein the tool coupler is detachably connectable to the drive end of the tool body by threadably connecting the tool coupler to the tool body.

* * * * *